US009988924B2

(12) United States Patent
Bacic et al.

(10) Patent No.: US 9,988,924 B2
(45) Date of Patent: Jun. 5, 2018

(54) ROTOR BLADE TIP CLEARANCE CONTROL

(71) Applicant: ROLLS-ROYCE PLC, London (GB)

(72) Inventors: Marko Bacic, Oxford (GB); Leo Vivian Lewis, Kenilworth (GB); Robert John Irving, Derby (GB)

(73) Assignee: ROLLS-ROYCE PLC, London (GB)

( * ) Notice: Subject to any disclaimer, the term of this patent is extended or adjusted under 35 U.S.C. 154(b) by 772 days.

(21) Appl. No.: 14/554,094

(22) Filed: Nov. 26, 2014

(65) Prior Publication Data

US 2015/0308282 A1 Oct. 29, 2015

(30) Foreign Application Priority Data

Dec. 19, 2013 (GB) ..... 1322532.1

(51) Int. Cl.
*F01D 11/24* (2006.01)
*F01D 5/06* (2006.01)
(Continued)

(52) U.S. Cl.
CPC ..... *F01D 11/24* (2013.01); *F01D 5/06* (2013.01); *F01D 9/02* (2013.01); *F01D 25/12* (2013.01);
(Continued)

(58) Field of Classification Search
CPC ... F01D 5/06; F01D 9/02; F01D 11/24; F01D 25/12; F01D 25/24; F05D 2220/32; F05D 2240/55; F05D 2260/20
See application file for complete search history.

(56) References Cited

U.S. PATENT DOCUMENTS 4,513,567 A * 4/1985 Deveau ..... F01D 11/08 415/178
5,351,732 A * 10/1994 Mills ..... F01D 11/24 415/115
(Continued)

FOREIGN PATENT DOCUMENTS

DE 197 34 216 A1 2/1998
EP 2 372 105 A2 10/2011
(Continued)

OTHER PUBLICATIONS

Search Report issued in British Application No. 1322532.1 dated Aug. 21, 2014.
Apr. 17, 2015 Search Report issued in British Application No. 14 19 4654.

*Primary Examiner* — Igor Kershteyn
(74) *Attorney, Agent, or Firm* — Oliff PLC

(57) ABSTRACT

A gas turbine engine comprising first and second axially spaced turbine rotor stages (46, 48) and a turbine casing (56) radially outside the rotor stages. A first seal segment arrangement (58) forms a cavity (64) radially between the first turbine rotor stage (46) and the turbine casing (56). A first air source (82) is coupled to the first seal segment arrangement (58). A second seal segment arrangement (70) forms a cavity (74) radially between the second turbine rotor stage (48) and the turbine casing (56). A heating chamber (84) is provided radially between the second seal segment arrangement (70) and the turbine casing (56). A duct (86) is coupled between the first air source (82) and the heating chamber (84).

21 Claims, 3 Drawing Sheets

(51) Int. Cl.
*F01D 9/02* (2006.01)
*F01D 25/12* (2006.01)
*F01D 25/24* (2006.01)

(52) U.S. Cl.
CPC ..... *F01D 25/24* (2013.01); *F05D 2220/32* (2013.01); *F05D 2240/55* (2013.01); *F05D 2260/20* (2013.01)

(56) References Cited

U.S. PATENT DOCUMENTS

| | | | | |
|---|---|---|---|---|
| 5,399,066 | A * | 3/1995 | Ritchie | F01D 11/24 165/47 |
| 5,779,436 | A | 7/1998 | Glezer et al. | |
| 6,659,716 | B1 | 12/2003 | Laurello et al. | |
| 7,165,937 | B2 * | 1/2007 | Dong | F01D 11/14 29/889.22 |
| 7,293,953 | B2 * | 11/2007 | Leach | F01D 11/10 415/116 |
| 2006/0042266 | A1 * | 3/2006 | Albers | F01D 5/082 60/782 |
| 2013/0149123 | A1 | 6/2013 | Laurello | |
| 2013/0266418 | A1 | 10/2013 | Snook | |

FOREIGN PATENT DOCUMENTS

| | | | |
|---|---|---|---|
| EP | 2 650 488 | A2 | 10/2013 |
| JP | 2004-044583 | A | 2/2004 |
| WO | 92/11444 | A1 | 7/1992 |

* cited by examiner

ROTOR BLADE TIP CLEARANCE CONTROL

The present invention relates to a gas turbine engine. In particular it relates to an arrangement to control the tip clearance of rotor stages.

A gas turbine engine 10 is shown in FIG. 1 and comprises an air intake 12 and a propulsive fan 14 that generates two airflows A and B. The gas turbine engine 10 comprises, in axial flow A, an intermediate pressure compressor 16, a high pressure compressor 18, a combustor 20, a high pressure turbine 22, an intermediate pressure turbine 24, a low pressure turbine 26 and an exhaust nozzle 28. A nacelle 30 surrounds the gas turbine engine 10 and defines, in axial flow B, a bypass duct 32.

It is beneficial to control the tip clearance between the radially outer tips of turbine blades and surrounding casing or seal segments. In particular it is beneficial to minimise the tip clearance since air passing through this gap does no useful work on the turbine blades. Some tip clearance is necessary to prevent the tips rubbing on the seal segments and damaging either or both components, and consequently permanently increasing the tip clearance. One method of controlling the tip clearance is to supply air to the casing to forcibly expand or contract it radially at a different rate to its natural growth rate. Thus cool air may be impinged on the outside of the turbine casing to cool the casing and cause it to expand and therefore increase the tip clearance.

EP2372105 teaches an arrangement to selectively supply relatively hot air to the inside of the turbine casing to heat it and cause it to expand. This has the effect of increasing the tip clearance. An embodiment of EP2372105 is shown in FIG. 2. A turbine blade 34 is radially surrounded by a turbine casing 36. Between the blade 34 and the casing 36 is a seal segment 38 which forms a cavity. An impingement cooling arrangement 40 provides cool air to impinge on the outside of the casing 36 when the valve is open. Within the seal segment cavity 38 is an impingement plate 42 which has an array of apertures therethrough.

Hot combusted gases F flow into the seal segment cavity 38. Some of the gases F are directed through the radially inner surface of the seal segment 38 to cool the radially inner surface of the seal segment 38. Some of the gases F are directed through the apertures in the impingement plate 42 when the valve 46 is open. These gases impinge on the casing 36 to heat it and thereby cause it to expand. Consequently the seal segment 38 is moved radially away from the turbine blades 34 and so the gap 44 is increased. Still more of the gases F are exhausted from the downstream side of the seal segment cavity 38.

As the operating temperatures of gas turbine engines 10 increase it is necessary to cool more than one turbine rotor stage. Furthermore, the performance penalty of extracting relatively cool air from a compressor stage to supply both the impingement cooling arrangement 40 and the seal segment 38 must be minimised. One problem with the arrangement described in EP2372105 is that it cannot be economically scaled to control the tip clearance gap 44 for more than one turbine rotor stage because all the components must be supplied for each rotor stage. Furthermore, the performance penalty is incurred for each rotor stage.

The present invention provides a gas turbine engine that seeks to address the aforementioned problems.

Accordingly the present invention provides a gas turbine engine comprising:

- a first turbine rotor stage and a second turbine rotor stage, the first and second turbine rotor stages being axially spaced;
- a turbine casing radially outside the first and second turbine rotor stages;
- a first seal segment arrangement forming a cavity radially between the first turbine rotor stage and the turbine casing;
- a first air source coupled to the first seal segment arrangement;
- a second seal segment arrangement forming a cavity radially between the second turbine rotor stage and the turbine casing;
- a heating chamber radially between the second seal segment arrangement and the turbine casing; and
- a duct coupled between the first air source and the heating chamber.

Advantageously there is a significant increase in the speed at which the turbine casing is radially expanded to accommodate rapid transient conditions such as step climb.

The duct may comprise a valve to selectively open or close the duct. Advantageously the air supplied to the first seal segment may be directed to the heating chamber in some phases of operation and not in other phases.

The duct may be further coupled to the first seal segment arrangement. The duct is thereby arranged to direct, in use, at least a portion of air supplied to the first seal segment into the heating chamber. Advantageously the air from the first air source is reused.

A second air source may be coupled to the second seal segment arrangement. The first air source is arranged to supply, in use, cooling air to the first seal segment. The second air source is arranged to supply, in use, cooling air to the second seal segment. The first air source supplies air that is hotter and at higher pressure than that supplied by the second air source.

Each of the first and second seal segment arrangements may comprise an array of apertures to direct, in use, cooling air towards the first and second turbine rotor stages respectively. Advantageously this air acts to cool the first seal segment and second seal segment respectively.

Each of the first seal segment arrangement, second seal segment arrangement and heating chamber may comprise an annular cavity. Alternatively each of the first seal segment arrangement, second seal segment arrangement and heating chamber may comprise an annular array of cavities.

The heating chamber may comprise an array of apertures through its radially outer surface. Advantageously the apertures direct air to impinge on the radially inner surface of the turbine casing to cause it to radially expand relatively rapidly. The apertures may be regularly spaced circumferentially. The apertures may be regularly or irregularly spaced axially. For example, the apertures may be densely positioned axially where the casing is thicker, or aligned with the axial centre of the second turbine rotor stage and more sparsely positioned in other regions.

The first seal segment arrangement may comprise an impingement plate at a radially intermediate position between the seal segment and the turbine casing. The impingement plate may comprise an array of apertures therethrough. The apertures may direct air, in use, to impinge on the turbine casing in the vicinity of the first turbine rotor stage.

The first air source may be coupled to a compressor bleed valve. The second air source may be coupled to a compressor bleed valve. Advantageously the second air source may be coupled to a cooler, lower pressure source than the first air source.

The gas turbine engine may further comprise an exhaust duct coupled to the heating chamber. The exhaust duct may be directed axially rearward of the second turbine rotor stage. Advantageously this minimises the additional pipework that is necessary and therefore reduces weight. The exhaust duct may be directed radially outward through the turbine casing. Advantageously this enables the air to be used in other places in the gas turbine engine or to be combined with other flows. The exhaust duct may be coupled to a manifold, a bleed valve exhaust duct or another component of the gas turbine engine.

The first and second turbine rotor stages may be mounted to the same shaft. Alternatively the first and second turbine rotor stages may be mounted to different shafts, which may co-rotate or contra-rotate. The gas turbine engine may comprise a turbine stator stage located axially between the first and second turbine rotor stages.

The gas turbine engine may further comprise an impingement cooling arrangement radially outside the turbine casing and aligned with the first turbine rotor stage. The gas turbine engine may further comprise an impingement cooling arrangement radially outside the turbine casing and aligned with the second turbine rotor stage. The gas turbine engine may further comprise an impingement cooling arrangement radially outside the turbine casing and aligned with each of the first and second turbine rotor stages.

Where two or more impingement cooling arrangements are provided, the gas turbine engine may comprise a controller to control each impingement cooling arrangement. The gas turbine engine may comprise a controller that controls both impingement cooling arrangements.

The first and second turbine rotor stage each comprises an annular array of turbine blades. Each turbine blade has a tip at its radially outer end. There is a tip clearance gap between the tips of the turbine blades and the seal segments.

The array of apertures through each of the impingement plate of the first seal segment and the radially outer surface of the heating chamber are arranged to direct, in use, air to impinge on the turbine casing to heat it and cause it to radially expand. Advantageously this causes the seal segments mounted thereto to move radially outwardly away from the turbine rotor stages and thereby to increase the tip clearance gap. Advantageously the tip clearance gap can therefore be expanded rapidly during transient phases such as step climb, but be reduced during cruise and similar phases with a resultant performance improvement.

Any combination of the optional features is encompassed within the scope of the invention except where mutually exclusive.

The present invention will be more fully described by way of example with reference to the accompanying drawings, in which.

Figure 1:
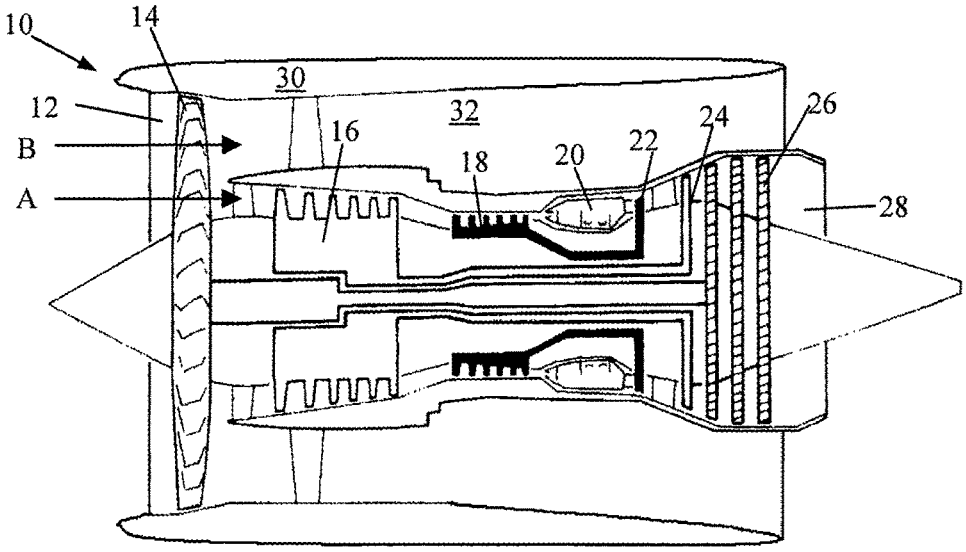
FIG. 1 is a sectional side view of a gas turbine engine.
Figure 2:
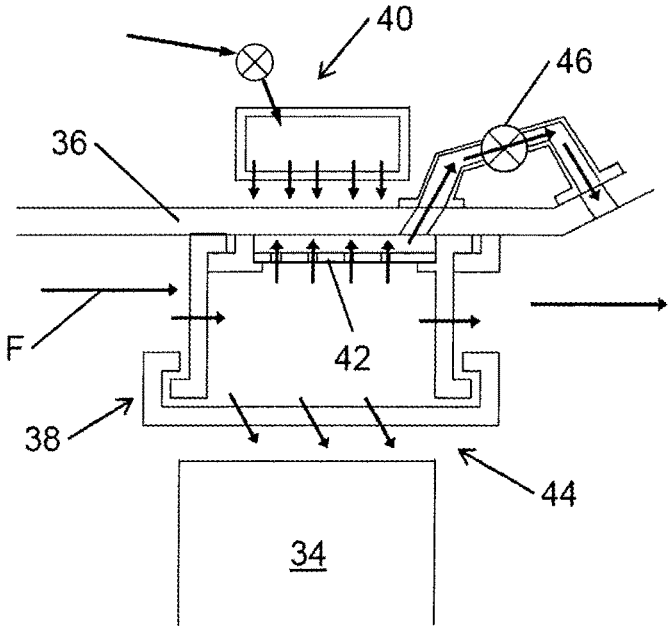
Figure 2 Related Art
FIG. 2 is a schematic illustration of a prior art arrangement.
Figure 3:
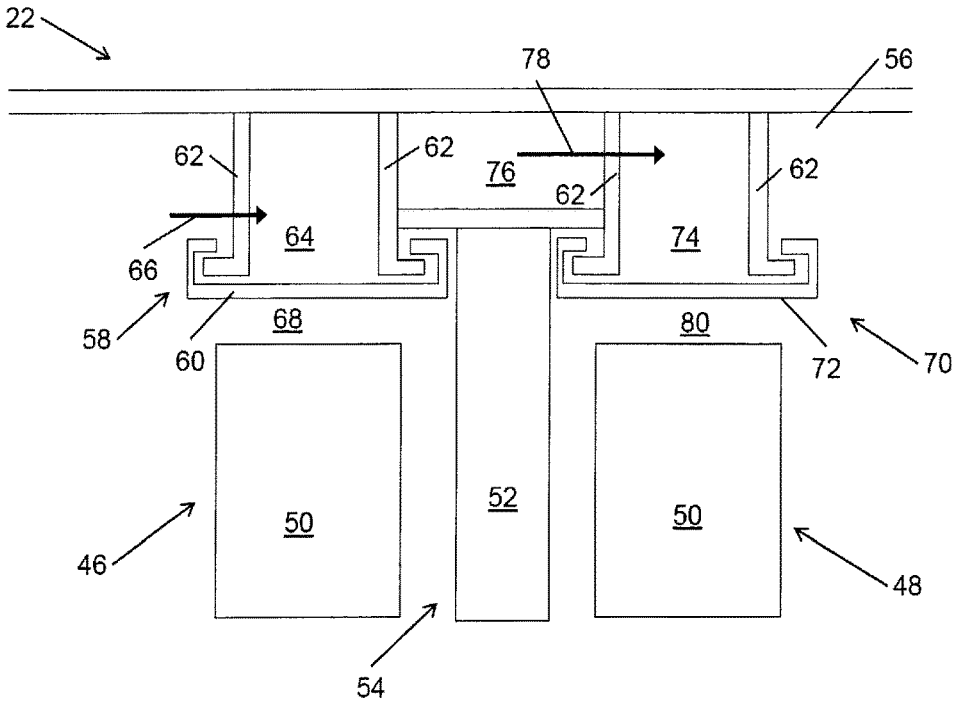
FIG. 3 is a schematic illustration of part of a gas turbine engine to which the present invention can be applied.

FIG. 3 shows a turbine, for example a high pressure turbine 22, of a gas turbine engine 10. Unlike the conventional gas turbine engine 10 shown in FIG. 1, the high pressure turbine 22 has a first turbine rotor stage 46 and a second turbine rotor stage 48. Each rotor stage 46, 48 comprises an annular array of turbine blades 50. The first rotor stage 46 is axially forward of, and spaced from, the second rotor stage 48; that is, the first rotor stage 46 receives the hot combustion gases from the combustor 20 whereas the second rotor stage 48 receives gases from the first rotor stage 46. Axially between the first and second rotor stages 46, 48 is an annular array of turbine stators 52 forming a turbine stator stage 54.

Radially outside the first rotor stage 46, the stator stage 54 and the second rotor stage 48 is a turbine casing 56. A first seal segment arrangement 58 is provided radially inward of the turbine casing 56 and radially outward of the turbine blades 50 of the first rotor stage 46. More precisely the first seal segment arrangement 58 comprises a first seal segment 60 that extends annularly and a pair of segment carriers 62 that extend radially inwards from the turbine casing 56. The first seal segment 60 and segment carriers 62 comprise interacting features such that the first seal segment 60 is suspended from the turbine casing 56 by the segment carriers 62. The first seal segment 60, segment carriers 62 and part of the turbine casing 56 together form a first seal segment cavity 64. The first seal segment cavity 64 may be an annular chamber or may be an annular array of chambers with common or abutting walls that extend radially at intervals around the circumference of the turbine casing 56.

As in EP2372105, a flow of relatively hot, high pressure air is supplied to the first seal segment cavity 64 as shown by arrow 66. At least some of this air is directed through apertures in the first seal segment 60 to cool the first seal segment 60. Optionally not all of the annular array of first seal segments 60 may include the cooling flow.

A second seal segment arrangement 70 is provided radially inward of the turbine casing 56 and radially outward of the turbine blades 50 of the second rotor stage 48. It is similar to the first seal segment arrangement 58. More precisely the second seal segment arrangement 70 comprises a second seal segment 72 that extends annularly and a pair of segment carriers 62 that extend radially inwards from the turbine casing 56. The second seal segment 72 and segment carriers 62 comprise interacting features such that the second seal segment 72 is suspended from the turbine casing 56 by the segment carriers 62. The second seal segment 72, segment carriers 62 and part of the turbine casing 56 together form a second seal segment cavity 74. The second seal segment cavity 74 may be an annular chamber or may be an annular array of chambers with common or abutting walls that extend radially at intervals around the circumference of the turbine casing 56.

The second seal segment cavity 74 receives a flow of relatively hot, high pressure air, for example from a cavity 76 radially outward of stator stage 54, as shown by arrow 78. At least some of this air is directed through apertures in the second seal segment 72 to cool the second seal segment 72. Optionally not all of the annular array of second seal segments 72 may include the cooling flow. The flow of air 78 that is supplied to the second seal segment cavity 74 is at a lower temperature and pressure than the air supplied to the first seal segment cavity 64. For example the flow 78 may be provided from a more axially forward compressor stage than the flow 66. Advantageously this is less detrimental to the engine performance whilst providing sufficient tip clearance control for the axially rearward second turbine rotor stage 48.

Some of the relatively hot, high pressure air in cavity 76 may be directed towards the turbine stators 52 to cool them.

An impingement cooling arrangement, or one arrangement aligned with each rotor stage 46, 48, may also be provided to cool the turbine casing 56 in the region of one or both rotor stages 46, 48. This is not shown in the figures so as not to obscure other features of the invention.

Figure 4:
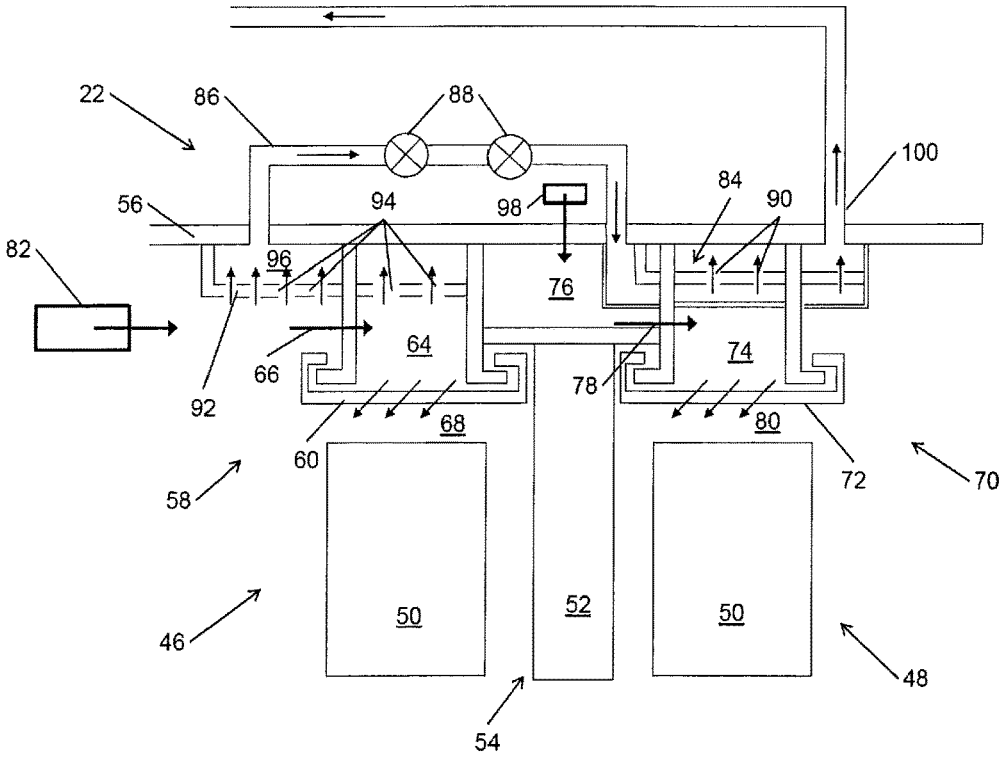
FIG. 4 is a schematic illustration of part of a gas turbine engine according to the present invention.

FIG. 4 shows features of the present invention in addition to the features described in relation to FIG. 3. The gas turbine engine 10 includes a first air source 82. The first air source 82 may be, for example, a bleed duct downstream of a bleed valve that extracts working fluid from a stage of a compressor 16, 18. Since the air is to be used to heat the turbine casing 56 it may be beneficial for the first air source 82 to be or be supplied by a bleed duct from a stage in the high pressure compressor 18, for example from close to the combustor 20. The first air source 82 provides the flow 66 of hot, high pressure air to the first seal segment cavity 64. For example, the first air source 82 may be coupled to the first seal segment cavity 64 by suitable ducts or pipes. Preferably the first air source 82 is located radially inside the turbine casing 56 in the vicinity of the turbines 22, 24, 26.

A heating chamber 84 is provided radially between the second seal segment cavity 74 and the turbine casing 56. The heating chamber 84 is either annular or formed of an annular array of circumferentially extending chambers separated by common or adjacent radial walls. The heating chamber 84 may be partially defined by the segment carriers 62 of the second seal segment arrangement 70.

A duct 86 is arranged to couple the first air source 82 to the heating chamber 84 in order to deliver hot, high pressure air from the first air source 82 into the heating chamber 84. Preferably the duct 86 is routed to pass through the turbine casing 56 from axially forward of the first seal segment arrangement 58, to be substantially parallel to the outside of the turbine casing 56, and to pass back through the turbine casing 56 to supply the heating chamber 84. In one embodiment the heating chamber 84 may be formed as an axial extension of the duct 86, which may have expanded internal dimensions in the radial and/or circumferential directions.

Optionally the duct 86 may include one or more valves 88 that can control whether or not air is directed from the first air source 82 along the duct 86 and into the heating chamber 84. The valve 88 may be a two position, on-off, valve or may have more than two positions or be fully modulating to provide more subtle control of the amount of air directed to the heating chamber 84 along the duct 86.

The heating chamber 84 includes an array of radial apertures 90 in its radially outer surface. The apertures 90 are arranged to divert at least some of the air flowing into and through the heating chamber 84 to impinge on the radially inner surface of the turbine casing 56. This has the effect of heating the turbine casing 56 in the area that is axially aligned with the second turbine rotor stage 48 and therefore causing it to radially expand. Beneficially the second seal segment 72 is thus moved away from the tips of the turbine blades 50 of the second rotor stage 48 and the tip clearance gap 80 is increased more quickly than is possible without this arrangement.

Optionally there is an impingement plate 92 provided radially inside the turbine casing 56 in axial alignment with the first rotor stage 46. The impingement plate 92 may axially span the first seal segment cavity 64. It includes an array of radial apertures 94 through it which are arranged to divert at least some of the flow 66 to impinge on the radially inner surface of the turbine casing 56. This has the effect of heating the turbine casing 56 in the area that is axially aligned with the first turbine rotor stage 46 and therefore causing it to radially expand. Beneficially the first seal segment 60 is thus moved away from the tips of the turbine blades 50 of the first rotor stage 46 and the tip clearance gap 68 is increased.

In an embodiment of the present invention the impingement plate 92 extends axially forward of the first rotor stage 46; particularly axially forward of the seal carrier 62 forming the axially front wall of the first seal segment cavity 64. There results an annular impingement chamber 96 that is defined by the impingement plate 92, part of the turbine casing 56 and part of the axially forward segment carrier 62. Thus a portion of the hot, high pressure air supplied by the first air source 82 passes through the apertures 94 in the impingement plate 92 to impinge on the turbine casing 56 from the impingement chamber 96 without first passing into the first seal segment cavity 64. This air then passes from the impingement chamber 96 into the duct 86.

Optionally some or all of the air which has passed through the first seal segment cavity 64 and into the impingement cavity 96 may then be directed into the duct 86. In this way the air from the first air source 82 is used three times: first to heat the turbine casing 56 in the area of the first rotor stage 46; second to cool the first seal segment 60; and third, when the valve 88 is open, to heat the turbine casing 56 in the area of the second rotor stage 48. Advantageously this re-use of the air from the first air source 82 reduces the performance penalty on the gas turbine engine 10 because no more air is needed to cause the turbine casing 56 to expand in the vicinity of two rotor stages 46, 48 than is required to cause it to expand in the vicinity of only one rotor stage.

Optionally the present invention also includes a second air source 98. The second air source 98 may be, for example, a bleed duct downstream of a bleed valve that extracts working fluid from a stage of a compressor 16, 18. Since the air is to be used to cool the second seal segment 72 and not to heat the turbine casing 56 it may be beneficial for the second air source 98 to be or be supplied by a bleed duct from a stage in the intermediate pressure compressor 16 or an early stage in the high pressure compressor 18, for example distant from the combustor 20. The second air source 98 provides the flow 78 of hot, high pressure air to the second seal segment cavity 74. For example, the second air source 98 may be coupled to the second seal segment cavity 74 via the cavity 76 by suitable ducts or pipes (not shown). The second air source 98 may be located radially inside or radially outside the turbine casing 56 in the vicinity of the turbines 22, 24, 26.

Advantageously because the second air source 98 is cooler and at a lower pressure than the first air source 82 the performance penalty incurred is lower than if both the flow 66 and the flow 78 were supplied by the first air source 82.

Figure 5:
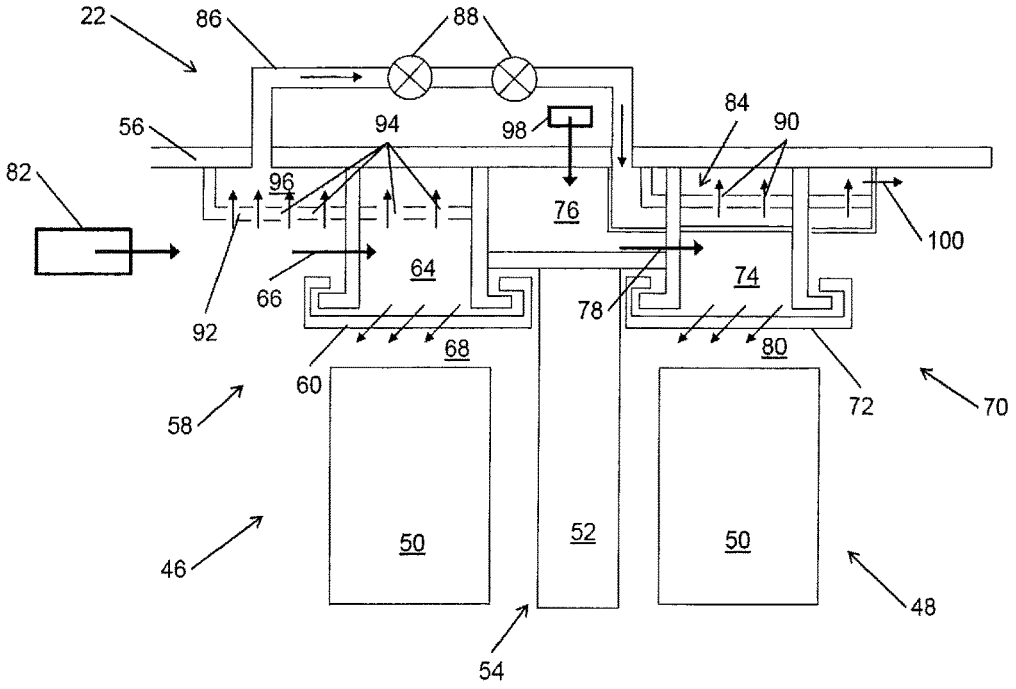
FIG. 5 is a schematic illustration of part of a gas turbine engine according to the present invention.
Figure 6:
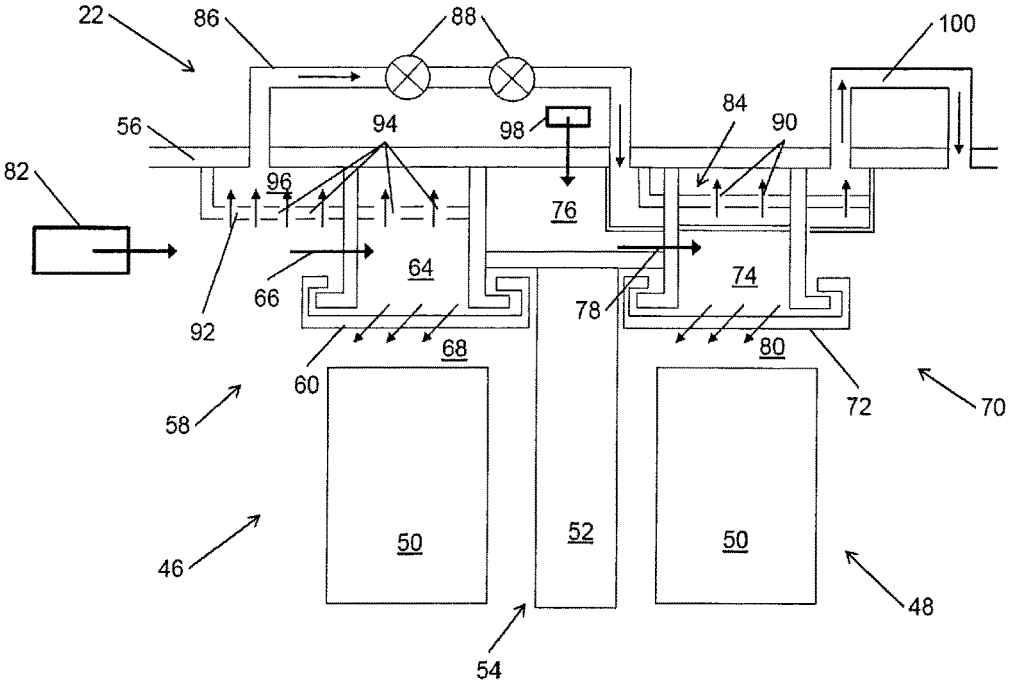
FIG. 6 is a schematic illustration of part of a gas turbine engine according to the present invention.

The heating chamber 84 may extend axially backward of the rearmost segment carrier 62 forming the second seal segment cavity 74. An exhaust duct 100 may be coupled to the heating chamber 84, either in axial alignment with the second rotor stage 48 or axially rearwards thereof. The heating chamber 84 may be coupled to the exhaust duct 100 by an array of apertures opening into a manifold. The exhaust duct 100 may extend radially out through the turbine casing 56 as shown in FIG. 4 and FIG. 6. Alternatively it may extend axially backward from the heating chamber 84 as shown in FIG. 5. The exhaust duct 100 may deliver the air used for impingement heating of the turbine casing 56 from the heating chamber 84 to a manifold or to join the exhaust duct from a bleed valve. Alternatively the exhaust duct 100 may deliver the air from the heating chamber 84 into the area that is inside the turbine casing 56 but axially rearward of the second turbine rotor stage 48, either directly as shown in FIG. 5 or indirectly by being ducted to the outside and then back to the inside of the turbine casing 56 as shown in FIG. 6.

Preferably the first turbine rotor stage 46 and the second turbine rotor stage 48 are mounted to the same shaft and therefore drive the same compressor. For example, both rotor stages 46, 48 may together form the high pressure turbine 22 and drive the rotor stages of the high pressure compressor 18. Alternatively the first turbine rotor stage 46 may be on one shaft and the second turbine rotor stage 48 may be on a different, concentric shaft. Thus the first turbine rotor stage 46 may be a high pressure turbine 22 driving a high pressure compressor 18, whilst the second turbine rotor stage 48 may be an intermediate pressure turbine 24 driving an intermediate pressure compressor 16. Where the two shafts contra-rotate, the stator stage 54 may be omitted without affecting the present invention. In this case the flow 78 will not pass through the cavity 76 but may be supplied directly from the second air source 98, for example.

Optionally the gas turbine engine 10 includes at least one impingement cooling arrangement 40 (not shown), as briefly described with respect to EP2372105. One impingement cooling arrangement 40 is located radially outside the turbine casing 56 and axially aligned with the first turbine rotor stage 46. The impingement cooling arrangement 40 acts in conventional manner to selectively supply cooling air to the outside of the turbine casing 56 to impinge against it and thereby cool it and cause the turbine casing 56 to radially contract and decrease the tip clearance 68 of the blades 50 of the first rotor stage 46. Preferably the impingement cooling arrangement 40 is used at different phases of operation of the gas turbine engine 10 than the heating arrangement of the present invention.

Optionally an impingement cooling arrangement 40 may be located radially outside the turbine casing 56 and axially aligned with the second turbine rotor stage 48. The impingement cooling arrangement 40 acts in conventional manner to selectively supply cooling air to the outside of the turbine casing 56 to impinge against it and thereby cool it and cause the turbine casing 56 to radially contract and decrease the tip clearance 80 of the blades 50 of the second rotor stage 48. Preferably the impingement cooling arrangement 40 is used at different phases of operation of the gas turbine engine 10 than the heating arrangement of the present invention.

Optionally there may be an impingement cooling arrangement 40 provided that supplies impingement cooling air to the turbine casing 56 at positions axially aligned with each of the rotor stages 46, 48. Alternatively there may be an impingement cooling arrangement 40 provided in axial alignment with each rotor stage 46, 48. Two controllers may be provided, one to control operation of each impingement cooling arrangement 40. Alternatively one controller may be provided that controls the operation of both impingement cooling arrangements 40, either to act simultaneously on the basis of one set of control signals or with separate control signals.

The present invention enables relatively rapid radial expansion of the turbine casing 56 in the vicinity of the first and second turbine rotor stages 46, 48. This is particularly advantageous for step-climb and aggressive auto-throttle engine operation conditions where the tip clearance 68, 80 is rapidly eroded. Indeed, the rate of expansion of the turbine casing 56 is often the limiting factor governing step-climb or auto-throttle transient control. Thus the present invention enables such limits to be increased, or even removed entirely, and thus the transient engine response to be improved.

The duct 86 may be an annular manifold or an annular array of ducts 86. Although two valves 88 have been shown in the duct 86, only one or more than two could be used as necessary for the particular application of the present invention. Alternatively the duct 86 may always be open with no valves 88 provided.

Although the turbine casing 56 has been shown and described as a single casing that extends axially to surround the first rotor stage 46, stator stage 54 and the second rotor stage 48 it may alternatively be formed in axial sections with suitable sealing between the sections. For example, there may be a first section of turbine casing 56 that surrounds the first rotor stage 46, a second section of turbine casing 56 that surrounds the stator stage 54 and a third section of turbine casing 56 that surrounds the second rotor stage 48.

The present invention has been described with reference to a gas turbine engine 10 for powering an aircraft. However, it may also be applied to a gas turbine engine 10 for marine or industrial applications. The benefits in such applications may be less pronounced because step-climb, a form of slam acceleration, and auto-throttle types of engine operation are less common.

The invention claimed is:

1. A gas turbine engine comprising:

a first turbine rotor stage and a second turbine rotor stage, the first and second turbine rotor stages being axially spaced;

a turbine casing radially outside the first and second turbine rotor stages, the turbine casing being configured to radially expand when air is directed to impinge on the turbine casing;

a first seal segment arrangement forming a cavity radially between the first turbine rotor stage and the turbine casing;

a first air source coupled to the first seal segment arrangement;

a second seal segment arrangement forming a cavity radially between the second turbine rotor stage and the turbine casing;

a heating chamber radially between the second seal segment arrangement and the turbine casing; and a duct coupled between the first air source and the heating chamber.

2. The gas turbine engine as claimed in claim 1, wherein the duct comprises a valve to selectively open or close the duct.

3. The gas turbine engine as claimed in claim 1, wherein the duct is further coupled to the first seal segment arrangement.

4. The gas turbine engine as claimed in claim 1, further comprising a second air source coupled to the second seal segment arrangement.

5. The gas turbine engine as claimed in claim 1, wherein each of the first and second seal segment arrangements comprises an array of apertures to direct, in use, cooling air towards the first and second turbine rotor stages respectively.

6. The gas turbine engine as claimed in claim 1, wherein each of the first seal segment arrangement, second seal segment arrangement and heating chamber comprises an annular cavity.

7. The gas turbine engine as claimed in claim 1, wherein each of the first seal segment arrangement, second seal segment arrangement and heating chamber comprises an annular array of cavities.

8. The gas turbine engine as claimed in claim 1, wherein the heating chamber comprises an array of apertures through its radially outer surface.

9. The gas turbine engine as claimed in claim 1, wherein the first seal segment arrangement comprises an impingement plate at a radially intermediate position, wherein the impingement plate comprises an array of apertures therethrough.

10. The gas turbine engine as claimed in claim 1, wherein the first air source is coupled to a compressor bleed valve.

11. The gas turbine engine as claimed in claim 4, wherein the second air source is coupled to a compressor bleed valve.

12. The gas turbine engine as claimed in claim 1, further comprising an exhaust duct coupled to the heating chamber.

13. The gas turbine engine as claimed in claim 12, wherein the exhaust duct is directed axially rearward of the second turbine rotor stage.

14. The gas turbine engine as claimed in claim 12, wherein the exhaust duct is directed radially outward through the turbine casing.

15. The gas turbine engine as claimed in claim 12, wherein the exhaust duct is coupled to a manifold, a bleed valve exhaust duct, or another component of the gas turbine engine.

16. The gas turbine engine as claimed in claim 1, wherein the first and second turbine rotor stages are mounted to the same shaft.

17. The gas turbine engine as claimed in claim 1, further comprising a turbine stator stage being located axially between the first and second turbine rotor stages.

18. The gas turbine engine as claimed in claim 1, further comprising an impingement cooling arrangement radially outside the turbine casing and aligned with one of the first and second turbine rotor stages.

19. The gas turbine engine as claimed in claim 1, further comprising an impingement cooling arrangement radially outside the turbine casing and aligned with each of the first and second turbine rotor stages.

20. The gas turbine engine as claimed in claim 19, further comprising a controller to control each impingement cooling arrangement.

21. The gas turbine engine as claimed in claim 19, further comprising a controller that controls both impingement cooling arrangements.

* * * * *